US006523897B2

(12) United States Patent
Pan

(10) Patent No.: US 6,523,897 B2
(45) Date of Patent: Feb. 25, 2003

(54) CHAIR ADJUSTABLE TO DIFFERENT HEIGHTS AND ANGLES

(76) Inventor: Toung Chun Pan, P.O. Box 10-69, Chong Ho, Taipei (TW)

( * ) Notice: Subject to any disclaimer, the term of this patent is extended or adjusted under 35 U.S.C. 154(b) by 14 days.

(21) Appl. No.: 09/819,562

(22) Filed: Mar. 27, 2001

(65) Prior Publication Data

US 2002/0140277 A1 Oct. 3, 2002

(51) Int. Cl.[7] ..... A47C 1/024

(52) U.S. Cl. ..... 297/302.1; 297/463.1; 297/300.2; 297/316; 297/325

(58) Field of Search ..... 297/302.1, 302.3, 297/302.7, 302.4, 300.4, 300.2, 300.8, 463.1, 316, 325, 326, 327, 328

(56) References Cited

U.S. PATENT DOCUMENTS 4,752,101 A * 6/1988 Yurencho et al. ..... 297/304
5,333,368 A * 8/1994 Kriener et al. ..... 297/301
5,762,399 A * 6/1998 Liu ..... 297/302.7
6,019,429 A * 2/2000 Tedesco ..... 297/328
6,022,077 A * 2/2000 Kirkland et al. ..... 297/334.19
6,102,477 A * 8/2000 Kurtz ..... 297/301.7
6,231,126 B1 * 5/2001 Cheng ..... 297/463.1
6,276,755 B1 * 8/2001 Su ..... 297/285
6,382,723 B1 * 5/2002 Piretti ..... 297/300.1

* cited by examiner

*Primary Examiner*—Peter M. Cuomo
*Assistant Examiner*—Stephanie Harris

(57) ABSTRACT

A chair includes an actuator having an actuator button disposed on top, a base secured on the actuator, a spring engaged in the base and having an actuator arm engaged on the actuator button for actuating the actuator button to release the actuator. A barrel is rotatably secured to the base. A bar is pivotally and adjustably secured to the base and adjustable relative to the base at any selected angular position. A latch is slidably engaged in the base and selectively engaged with the bar for adjustably securing the bar and the seat cushion to the base.

9 Claims, 7 Drawing Sheets

CHAIR ADJUSTABLE TO DIFFERENT HEIGHTS AND ANGLES

BACKGROUND OF THE INVENTION

1. Field of the Invention

The present invention relates to a chair, and more particularly to a chair having an adjusting mechanism for adjusting the chair to different heights and/or to different angular positions.

2. Description of the Prior Art

Typical seats or chairs include various kinds of adjusting devices or mechanism for adjusting the chairs to different heights. The other adjusting devices or mechanism may be used for adjusting the chairs to different heights. None of the prior chairs have an adjusting devices or mechanism for adjusting the chairs to different heights and to different angular positions.

The present invention has arisen to mitigate and/or obviate the afore-described disadvantages of the conventional chairs.

SUMMARY OF THE INVENTION

The primary objective of the present invention is to provide a chair including an adjusting mechanism that may be used for easily adjusting the chair to different heights and/or to different angular positions.

In accordance with one aspect of the invention, there is provided a chair comprising an actuator including an upper portion having an actuator button provided therein, a base secured on the upper portion of the actuator and including a front portion, a spring engaged in the base and including an actuator arm engaged on the actuator button of the actuator, and means for actuating the actuator arm of the spring to engage with and to actuate the actuator button and to release the actuator.

The spring includes two legs rotatably secured to the base, the actuating means is provided for rotating the spring about the legs thereof for forcing the actuator arm of the spring to actuate the actuator button.

The actuating means includes a barrel rotatably secured to the base, the spring includes an extension extended therefrom and engaged with the barrel for allowing the spring to be rotated about the legs thereof by the extension and the barrel.

A bar is further provided and includes a middle portion pivotally secured to the base with a pivot shaft and includes a rear portion and includes a front portion, a seat back secured to the rear portion of the bar, and means for securing the front portion of the bar to the base.

The securing means includes a plurality of apertures formed in the front portion of the bar, a latch slidably engaged in the base for selectively engaging into either of the apertures of the bar and for adjustably securing the bar to the base.

The base includes a conduit extended therefrom, the latch is slidably received in the conduit and extendible inward of the base to engage with either of the apertures of the bar and to adjustably secure the bar to the base.

A device is further provided for forcing the latch to engage into either of the apertures of the bar, and includes a barrel rotatably engaged onto the conduit, a follower slidably received in the barrel and having a bore formed therein for slidably receiving the latch, means for preventing the follower from rotating relative to the barrel, a tube rotatably received in the barrel and having a bore formed therein for slidably and partially receiving the follower, and means for moving the follower and the latch toward the bar when the tube is rotated relative to the follower.

The moving means includes a plurality of ratchet teeth formed on the follower and the tube and engaged with each other. The follower includes a plurality of notches formed between the ratchet teeth thereof, the ratchet teeth of the follower each includes a recess formed therein for receiving the ratchet teeth of the tube. A knob is further provided and secured to the tube for rotating the tube relative to the barrel.

A coupler includes a rear portion pivotally secured to the rear portion of the bar and includes a front portion, a board includes a front portion pivotally secured to the front portion of the base with a first pivot pole and includes a rear portion pivotally secured to the front portion of the coupler with a second pivot pole.

A device is further provided for biasing the board toward the base and includes a rod having a first end engaged with the board and having a second end extended through the base and extended downward beyond the base, and a spring engaged between the second end of the rod and the base.

A device is further provided for shielding the spring and includes a sleeve and a casing engaged on the rod and slidably engaged with each other, the spring is received in the sleeve and the casing.

A device is further provided for limiting the sleeve to move relative to the casing and to prevent the sleeve from being disengaged from the casing, and includes a peripheral flange formed on said sleeve and includes a peripheral flange formed on said casing and engaged with the peripheral flange of the sleeve for limiting the sleeve to move relative to the casing and to prevent the sleeve from being disengaged from the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 11:
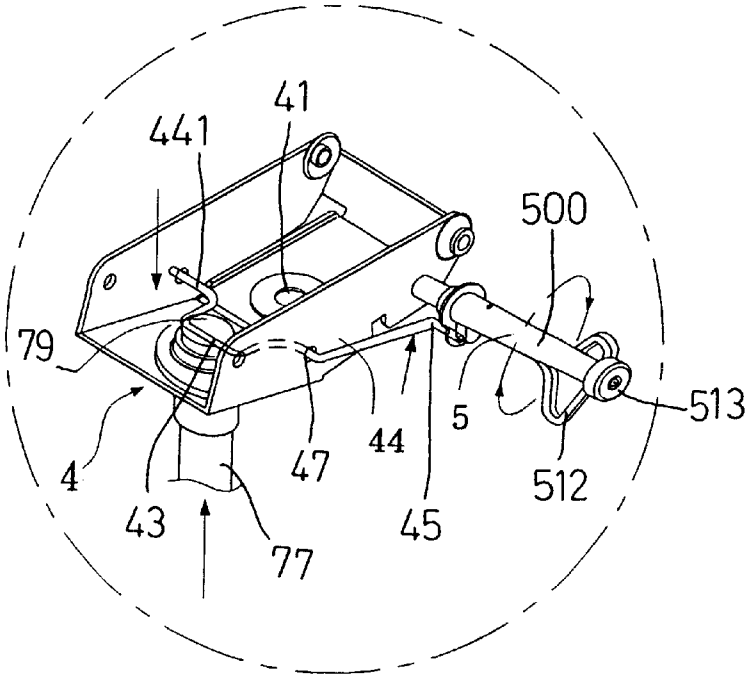

Referring to the drawings, and initially to FIGS. 1–8, a chair in accordance with the present invention comprises an actuator 77, such as a pneumatic cylinder or a hydraulic cylinder, disposed on top of a support or a leg device 78 and extended upward from the leg device 78. A base 4 includes a hub 400 secured on top of the actuator 77 and includes an orifice 41 formed therein and spaced from the hub 400, and includes a conduit 410 laterally extended from the front portion thereof and includes a hole 411 formed in the front portion thereof. The conduit 410 of the base 4 includes a hole 48 formed therein and a peripheral groove 49 formed in the outer peripheral portion of the free end thereof. The actuator 77 includes an actuator button 79 (FIGS. 4, 11) provided on top thereof and engaged or extended inward of the base 4.

Figure 9:
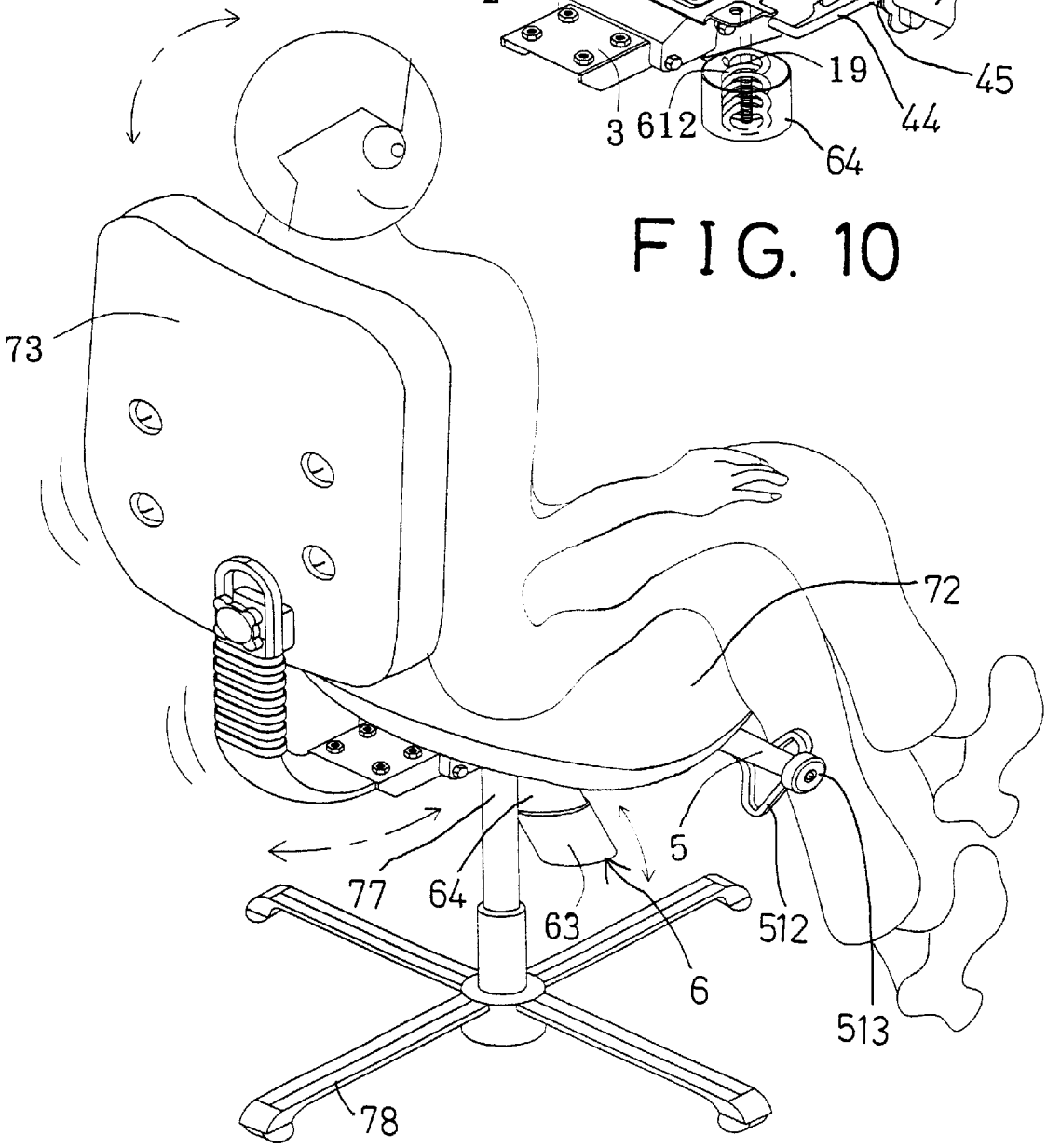
FIG. 9 is a rear perspective view showing the operation of the adjusting mechanism of the chair by the user.

A barrel 500 includes a bore 519 (FIG. 7) formed therein for rotatably receiving and for rotatably engaging onto the conduit 410 of the base 4, and includes a handle 512 provided thereon, particularly provided on the outer portion or on the free end portion for rotating the barrel 500 relative to the conduit 410 of the base 4. As shown in FIG. 9, the barrel 500 or the handle 512 of the barrel 500 may be easily rotated and actuated by the users. A fastener 59 (FIG. 4) may be engaged through a hole 510 of the barrel 500 and engaged into the peripheral groove 49 of the conduit 410, such that the barrel 500 may be rotatably secured onto the conduit 410 by the fastener 59 and will not be disengaged from the conduit 410.

A spring 44 (FIGS. 2, 3, 11) has two legs 441 rotatably engaged through the holes 47 of the base 4, and includes an actuating arm 43 extended therefrom and engaged on the actuator button 79 of the actuator 77 (FIG. 11) for depressing and actuating the actuator 77 and for allowing the actuator 77 to adjust the chair to different heights before the actuating arm 43 of the spring 44 is disengaged from the actuator button 79 of the actuator 77. The spring 44 includes an extension 45 extended therefrom and extended outward of the base 4 for engaging into a cavity 518 (FIG. 7) of the barrel 500. When the barrel 500 is rotated relative to the conduit 410 by the user, the spring 44 may be rotated about the legs 441 thereof such that the actuator arm 43 of the spring 44 may actuate the actuator button 79 of the actuator 77 to adjust the chair to different heights. Accordingly, the actuator 77 may be easily actuated by rotating the barrel 500.

A bar 3 includes a hole 35 formed in the middle portion thereof. A pivot shaft 29 is engaged through a hole 46 of the base 4 and the hole 35 of the bar 3 for rotatably or pivotally securing the middle portion of the bar 3 in the end portion of the base 4 with the pivot shaft 29, and for allowing the bar 3 to be rotated relative to the base 4 about the pivot shaft 29. A lock nut 31 may be threaded to the pivot shaft 29 for solidly securing the pivot shaft 29 to the base 4 and the bar 3. A seat back 73 has a lower portion secured to the rear end of the bar 3 with fasteners 33 such that the bar 3 may be rotated relative to the base 4 by depressing the seat back 73 by the users. The bar 3 includes a front portion having a number of apertures 36 and an orifice 37 formed therein, in which the orifice 37 of the bar 3 is aligned with the orifice 41 of the base 4.

Figure 1:
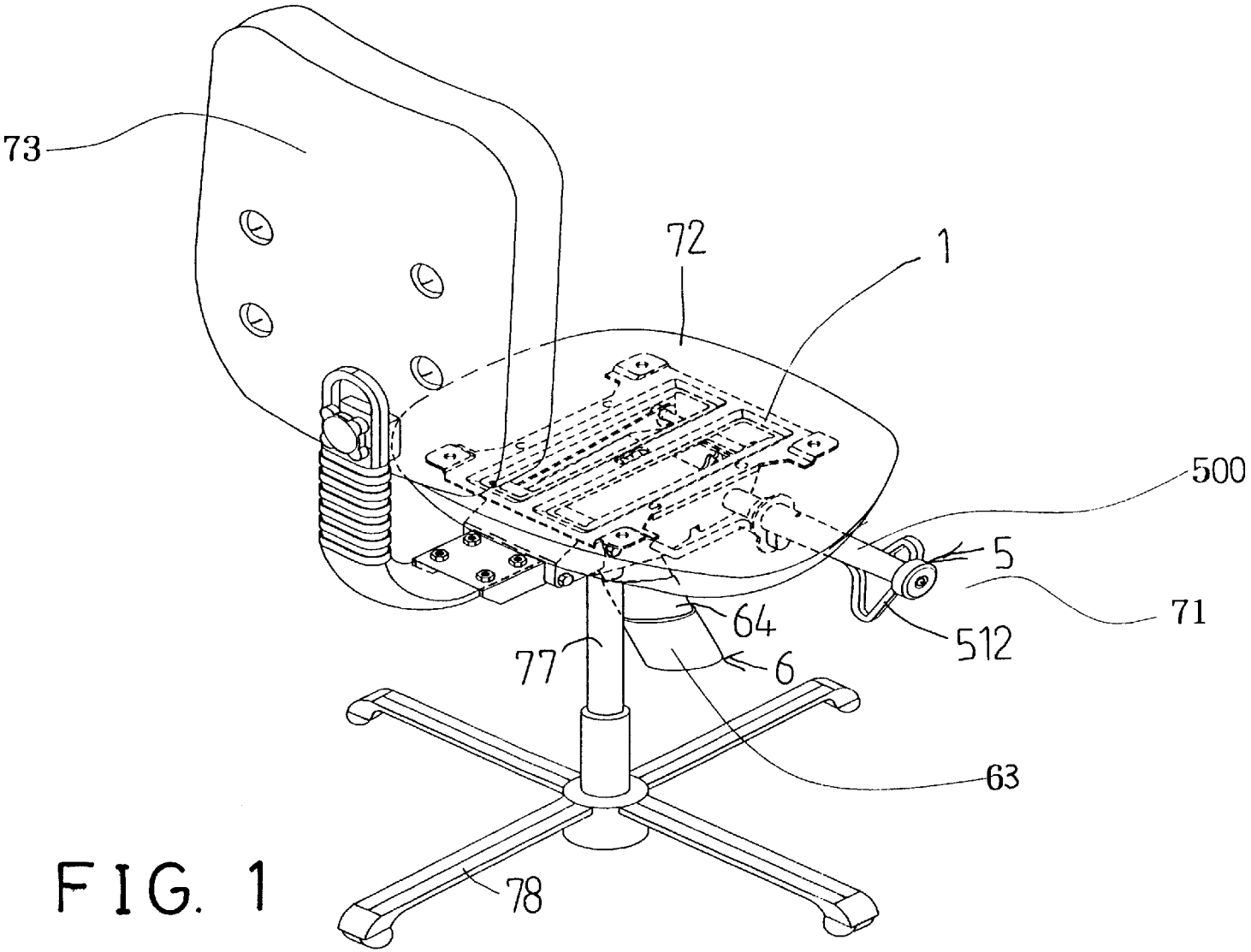
FIG. 1 is a rear perspective view of a chair in accordance with the present invention.
Figure 2:
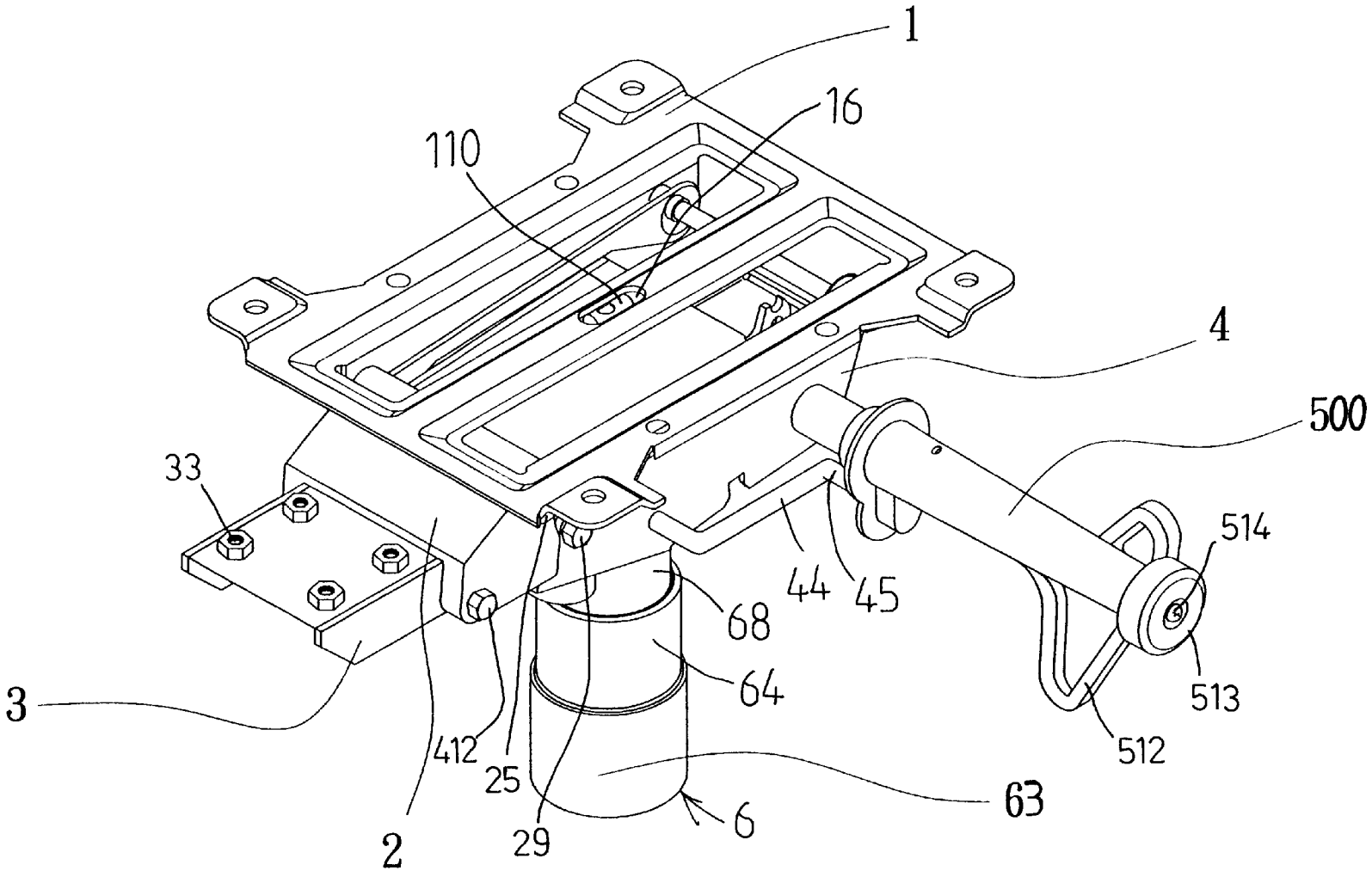
FIG. 2 is a partial perspective view showing a portion or an adjusting mechanism of the chair.
Figure 3:
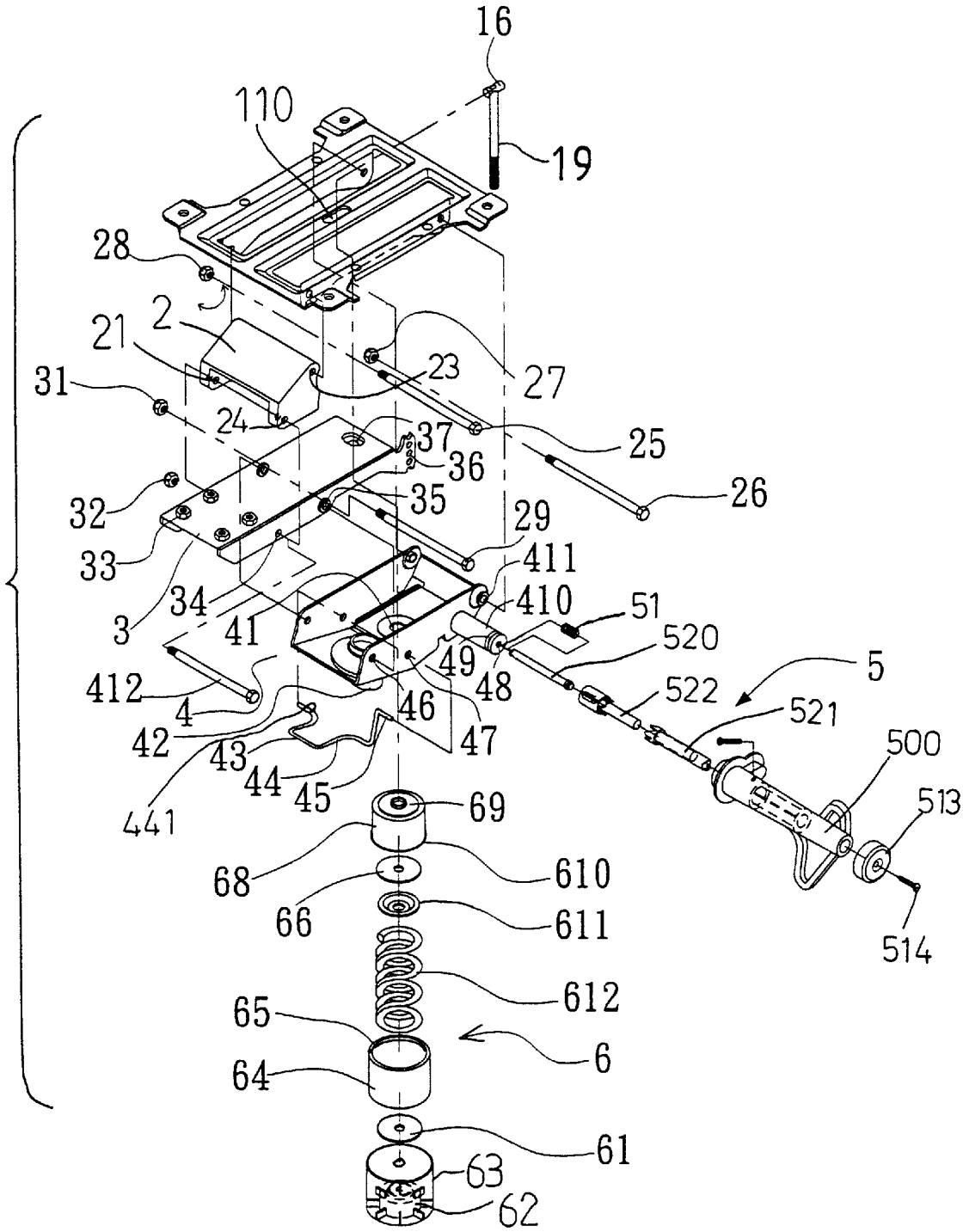
FIGS. 3, 4 are partial exploded views showing the elements of the adjusting mechanism of the chair.
Figure 5:
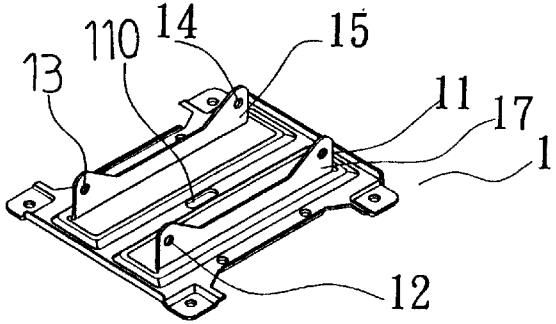
Figure 6:
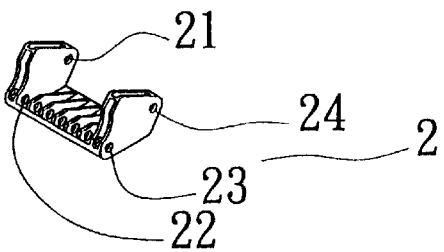

A coupler 2 includes two pairs of holes 21, 24; and 22, 23 formed in the rear portion and the front portion thereof respectively (FIGS. 3, 6). A pivot axle 412 is engaged through a rear hole 34 of the bar 3 and the rear holes 21, 24 of the coupler 2 and threaded with a lock nut 32 for pivotally or rotatably coupling the rear portion of the coupler 2 to the rear portion of the bar 3. A board 1 includes two ribs 15, 17 extended downward therefrom and each having a rear hole 14, 11 and a front hole 13, 12 formed therein (FIG. 5). A seat cushion 72 is secured on top of the board 1 for supporting the user. A pole 25 is engaged through the rear holes 14, 11 of the board 1 and the front holes 22, 23 of the coupler 2 and is threaded to a lock nut 28 for rotatably or pivotally securing the rear portion of the board 1 to the front portion of the coupler 2. Another pole 26 is engaged through the front holes 12, 13 of the board 1 and the front hole 411 of the base 4 and is threaded to a lock nut 27 for rotatably or pivotally securing the front portion of the board 1 to the front portion of the base 4.

It is to be noted that the coupler 2 is rotatably or pivotally secured between the bar 3 and the board 1, the board 1 may be rotated relative to the base 4 about the pole 26 and may be rotated relative to the coupler 2 about the pole 25, and the coupler 2 may be rotated relative to the bar 3, and the bar 3 may be rotated relative to the base 4.

Figure 10:
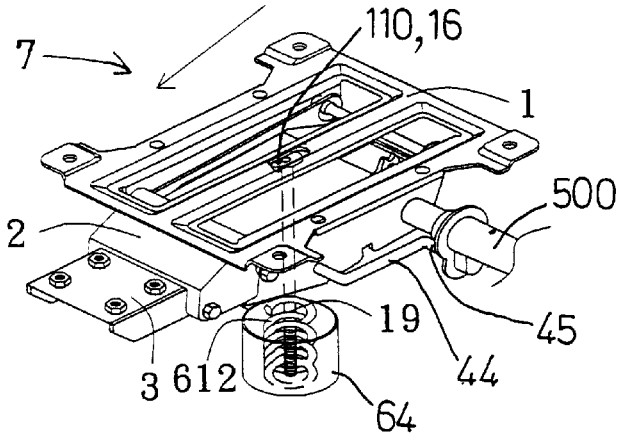
FIGS. 10, 11, 12 are partial perspective views showing the operation of the adjusting mechanism of the chair.

The board 1 includes an orifice 110 formed in the middle portion thereof and aligned with the orifices 37, 41 of the bar 3 and of the base 4. As shown in FIG. 10, a rod 19 is engaged through the orifices 110, 37, 41 of the board 1 and of the bar 3 and of the base 4, and includes an enlarged head 16 provided on top thereof and engaged with the board 1, such that the rod 19 may be moved up and down by the board 1. A stop 63 includes a screw hole 62 formed therein for threading to the bottom of the rod 19. A spring biasing device 6 includes one or more washers 61, 611, 66 and a sleeve 64 and a casing 68 engaged on the rod 19 and engaged between the base 4 and the stop 63, and a spring 612 engaged in the sleeve 64 and the casing 68 for biasing the rod 19 and thus the board 1 downward toward the base 4. The casing 68 includes an upper portion 69 engaged with the base 4, and includes a lower peripheral flange 610 extended radially outward therefrom for engaging with an upper peripheral flange 65 of the sleeve 64 and for limiting the relative sliding movement of the sleeve 64 and the casing 68 and for preventing the casing 68 from being disengaged from the sleeve 64, and for retaining the spring 612 within the sleeve 64 and the casing 68.

As shown in FIGS. 2–4, 8, 11 and 12, a follower 522 is slidably received in a bore 501 of the barrel 500 and includes a slot 524 formed in one end 526 thereof and slidably receiving a guide rib 511 of the barrel 500 such that the follower 522 may be guided to slide along the bore 501 of the barrel 500 and may not be rotated relative to the barrel 500. The follower 522 includes a bore 53 formed therein for partially receiving a latch 520. The latch 520 is engaged through the hole 48 of the conduit 410 of the base 4 for engaging with either of the apertures 36 of the bar 3 and for adjustably securing the bar 3 and thus the seat cushion 72 relative to the base 4 at different or at the selected angular position. A spring 51 is engaged between the latch 520 and the conduit 410 for biasing the latch 520 away from the bar 3 and for allowing the bar 3 to be adjusted relative to the base 4 to any suitable or selected angular position.

Figure 4:
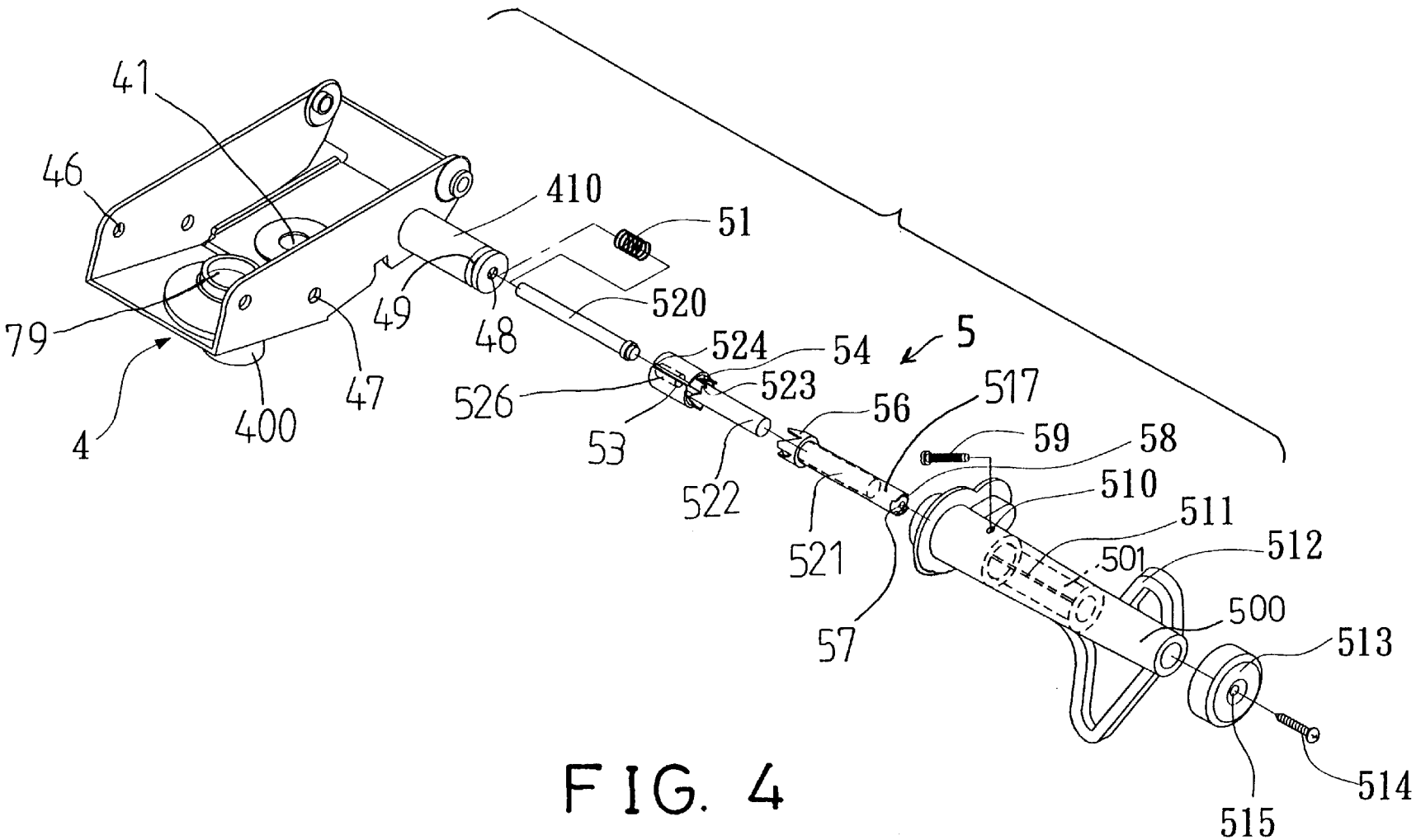
Figure 7:
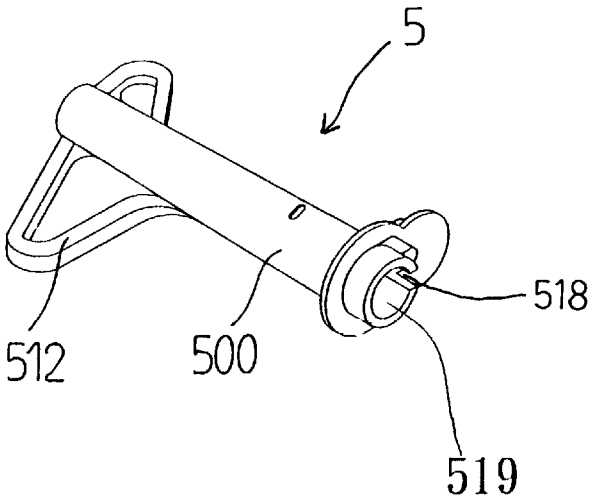
FIGS. 5, 6, 7, 8 are perspective views showing the elements of the adjusting mechanism of the chair respectively.
Figure 8:
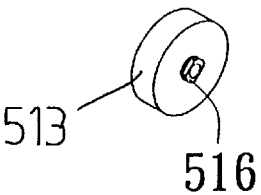

The follower 522 includes one or more notches 525 formed in the outer peripheral portion thereof and formed or defined between ratchet teeth 54, and includes one or more recesses 523 formed in the tips of the ratchet teeth 54 respectively (FIG. 4). It is to be noted that the notches 525 are formed between the ratchet teeth 54, and the recesses 523 are formed in the tips of the ratchet teeth 54 respectively, such that the depth of the recesses 523 is less or smaller than that of the notches 525 of the follower 522.

A tube 517 is rotatably received in the barrel 500 and includes a notch 58 and a screw hole 57 formed in the outer end thereof. A knob 513 includes a hole 515 formed therein and includes a projection 516 extended from one end thereof (FIG. 8) and engaged with the notch 58 of the tube 517, and a fastener 514 is engaged through the hole 515 of the knob 513 and threaded to the screw hole 57 of the tube 517 such that the knob 513 may be solidly secured to the tube 517 and such that the tube 517 may be rotated relative to the barrel 500 by the knob 513. The tube 517 includes a bore 521 formed therein for rotatably receiving the follower 522, and includes one or more ratchet teeth 56 extended from the inner end thereof for engaging with the ratchet teeth 54 of the follower 522 and for engaging into either the notches 525 or the recesses 523 of the follower 522.

Figure 12:
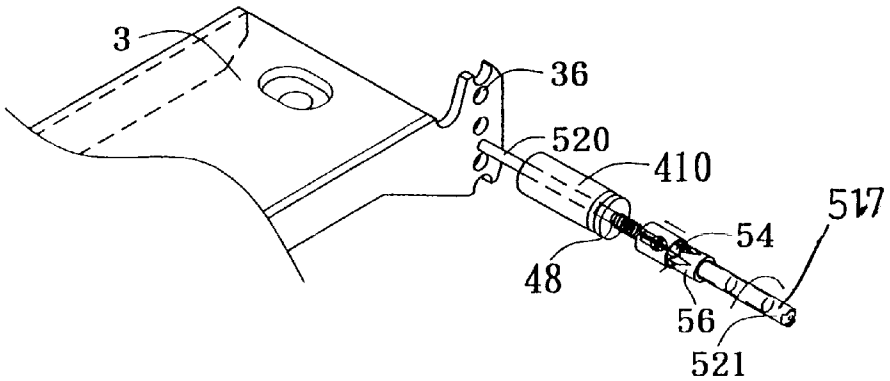
Figure 13:
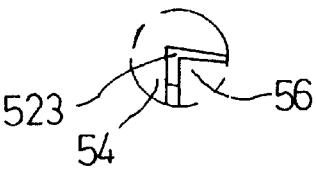

In operation, as shown in FIGS. 12, when the tube 517 is rotated by the user with the knob 513, the follower 522 and thus the latch 520 may be forced to engage into either of the apertures 36 of the bar 3 in order to secure the bar 3 and the seat cushion 72 at any selected angular position relative to the base 4, by the sliding engagement between the ratchet teeth 56, 54. The ratchet teeth 56 of the tube 517 may be engaged in the recesses 523 of the ratchet teeth 54 of the follower 522 (FIG. 13), and the spring 51 may bias the follower 522 against the tube 517 for biasing and maintaining the ratchet teeth 56 in the recesses 523 of the ratchet teeth 54, and thus for retaining the latch 520 in the aperture 36 of the bar 3.

Figure 14:
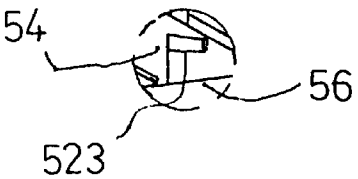
FIGS. 13, 14 are enlarged partial plane views showing the operation of the adjusting mechanism of the chair

The ratchet teeth 56 of the tube 517 may be disengaged from the recesses 523 of the ratchet teeth 54 of the follower 522 (FIG. 14) by rotating the tube 517 relative to the barrel 500 with the knob 513, and the spring 51 may bias the latch 520 away from the bar 3, for allowing the bar 3 and thus the seat cushion 72 to be adjusted relative to the base 4 to any suitable or selected angular position, when the ratchet teeth 56 of the tube 517 are engaged into the notches 525 of the follower 522.

When the tube 517 is rotated relative to the follower 522 again to disengage the ratchet teeth 56 of the tube 517 from the notches 525 of the follower 522, the follower 522 and thus the latch 520 may be forced to move against the spring 51 and may be forced to engage into either of the apertures 36 of the bar 3 gain in order to secure the bar 3 and the seat cushion 72 at any selected angular position relative to the base 4 again, by the sliding engagement between the ratchet teeth 56, 54.

It is to be noted that the actuator button 79 of the actuator 77 may be easily actuated by rotating the barrel 500 by the user, in order to adjust the seat cushion 72 to different heights. The latch 520 may be easily actuated to engage into either of the apertures 36 of the bar 3 or to be disengaged from the bar 3 by rotating the knob 513, such that the seat cushion 72 or the seat back 73 may be easily adjusted to different angular position relative to the base 4 by the knob 513.

Accordingly, the chair in accordance with the present invention includes an adjusting mechanism that may be used for easily adjusting the chair to different heights and/or to different angular positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chair comprising:

a) an actuator including an upper portion having an actuator button provided therein, b) a base secured on said upper portion of said actuator and including a front portion, said base including a conduit extended therefrom, c) a barrel rotatably engaged onto said conduit of said base, d) a spring engaged in said base and including an actuator arm engaged on said actuator button of said actuator, said spring including an extension extended therefrom and engaged with said barrel for allowing said spring to be rotated relative to said base by said extension of said spring and said barrel, e) a bar including a middle portion pivotally secured to said base with a pivot shaft, and including a rear portion, and including a front portion having a plurality of apertures formed therein, f) a seat back secured to said rear portion of said bar, g) a latch slidably received in said conduit of said base, and extendible inward of said base to engage with either of said apertures of said bar and to adjustably secure said bar to said base, h) a follower slidably received in said barrel and having a bore formed therein for slidably receiving said latch, i) a tube rotatably received in said barrel and having a bore formed therein for slidably and partially receiving said follower, and j) means for moving said follower and said latch toward said bar when said tube is rotated relative to said follower.

2. The chair according to claim 1, wherein said moving means includes a plurality of ratchet teeth formed on said follower and said tube and engaged with each other.

3. The chair according to claim 2, wherein said follower includes a plurality of notches formed between said ratchet teeth thereof, said ratchet teeth of said follower each includes a recess formed therein for receiving said ratchet teeth of said tube.

4. The chair according to claim 1 further comprising a knob secured to said tube for rotating said tube relative to said barrel.

5. The chair according to claim 1 further comprising means for preventing said follower from rotating relative to said barrel.

6. The chair according to claim 1 further comprising a coupler including a rear port ion pivotally secured to said rear portion of said bar and including a front portion, a board including a front portion pivotally secured to said front portion of said base with a first pivot pole and including a rear portion pivotally secured to said front portion of said coupler with a second pivot pole.

7. The chair according to claim 6 further comprising a rod having a first end engaged with said board and having a second end extended through said base and extended downward beyond said base, and a spring member engaged between said second end of said rod and said base.

8. The chair according to claim 7 further comprising a sleeve and a casing engaged on said rod and slidably engaged with each other, said spring member is received in said sleeve and said casing.

9. The chair according to claim 8, wherein said sleeve includes a peripheral flange formed thereon, said casing also includes a peripheral flange formed thereon and engaged with said peripheral flange of said sleeve for limiting said sleeve to move relative to said casing and to prevent said sleeve from being disengaged from said casing.

* * * * *